US008502658B2

(12) United States Patent
Pan

(10) Patent No.: US 8,502,658 B2
(45) Date of Patent: Aug. 6, 2013

(54) SECURITY IMPLEMENTED WITH A COMMUNICATION DEVICE

(76) Inventor: Fu-Cheng Pan, Taipei (TW)

( * ) Notice: Subject to any disclaimer, the term of this patent is extended or adjusted under 35 U.S.C. 154(b) by 413 days.

(21) Appl. No.: 12/986,255

(22) Filed: Jan. 7, 2011

(65) Prior Publication Data

US 2012/0154142 A1 Jun. 21, 2012

(30) Foreign Application Priority Data

Apr. 27, 2010 (TW) ..... 99113254 A

(51) Int. Cl.
*G08B 21/00* (2006.01)

(52) U.S. Cl.
USPC . 340/539.11; 340/506; 340/531; 340/539.14; 348/143

(58) Field of Classification Search
USPC ..... 340/506, 531, 539.11, 539.14; 348/143
See application file for complete search history.

(56) References Cited

U.S. PATENT DOCUMENTS

| | | | | |
|---|---|---|---|---|
| 7,123,126 | B2 * | 10/2006 | Tanaka et al. | 340/5.2 |
| 2002/0145507 | A1 * | 10/2002 | Foster | 340/5.53 |
| 2006/0007318 | A1 * | 1/2006 | Kanayama et al. | 348/211.3 |
| 2007/0262857 | A1 * | 11/2007 | Jackson | 340/506 |

FOREIGN PATENT DOCUMENTS

| | | |
|---|---|---|
| TW | 588291 | 2/2003 |

* cited by examiner

*Primary Examiner* — Mohammad Ghayour
*Assistant Examiner* — Mark Rushing
(74) *Attorney, Agent, or Firm* — Chun-Ming Shih; HDLS IPR Services

(57) ABSTRACT

A security system implemented with a communication device includes a remote communication device, a local communication device, a main controller and at least one main sensor. The remote communication device and local communication device are connected via communication connection. Each main sensor detects status of a monitoring location. When each main sensor is triggered, each main sensor sends an output signal to the main controller. The main controller collects and processes each output signal, and transmits the processed output signals to the local communication device. The local communication device transforms receives output signals into a text warning message. The text warning message transmits to remote communication device via Short Message Service whereby a user is informed of the status occurred in a remote monitoring location.

19 Claims, 4 Drawing Sheets

SECURITY IMPLEMENTED WITH A COMMUNICATION DEVICE

BACKGROUND OF THE INVENTION

1. Field of the Invention

The present invention relates to a security system, in particular, the present invention relates to a security system implemented with a communication device.

2. Description of Prior Art

As the social structure and values change, crime rate has being increasing in recent years and securities issues are getting more attentions from the general public. As a result, people concern more and more about the securities issues in order to protect security of one's own and the properties which generate stronger demands towards security systems.

Typically, security systems are installed in valuable manufacturing facilities or shops or personal residence of security concerns in order to assure the safety of commodities, properties, individuals and family members. Further, current security systems are mostly linked to security companies in addition to crime prevention. Accordingly, security systems are also used for early detection on unexpected accidents (such as a fire accident). Though, security systems provided by security companies are expensive and heavy financial burdens to users. There are simple and convenient new applications of security systems in the market which are implemented by different types of detectors for monitoring target locations (such as a residence). Such security systems send warning signal to users when the status becomes unusual, whereby the target locations are protected at a certain security level without extra high cost from users.

For example, Taiwan Pat. 588291 discloses a wireless security system. FIG. 1 is an architecture diagram of a prior art wireless security system. As shown in the diagram, the wireless security system comprises a user end 1 and a monitor end 2 which transmits wireless signals to each other via a base station 3. The user end 1 has a detector 11, a host 12 and a wireless transmitter 13. The detector 11 is used for installing on doors, windows and specific regions to detect background changes in detected areas. In addition, when background change value is detected, the background change value is transmitted to the host 12. Thus, the host 12 generates a signal according to the background change value (not shown). The signal is wireless transmitted to the base station 3 via the wireless transmitter 13. The monitor end 2 has a wireless receiver 21 and a signal processing device 22. The wireless receiver 21 receives the signal sent by the user end 1 via the base station 3, and transmits the signal to the signal processing device 22 for further processing. Thus, user act on the result generated from signal processing by the signal processing device 22.

Nonetheless, the above mentioned security system is an alarming system for one way signal transmission. Signals are generated and sent to monitor end 2 when the detector 11 detects background change values. Further, the user end 1 determines on the situations occurred based on received signals, and is not allowed to receive further information, such as sound or films in the above mentioned security system. As a result, there are improved security systems introduced later to use cameras in security systems. The cameras are installed in the monitored locations and connected to the Internet. The cameras are controlled via the Internet for receiving pictures or films recorded by the cameras.

Nonetheless, the use of Internet involves with complicated setup operations and it is required to install Internet Servers for transmitting messages, pictures or images. Otherwise, users have to pay rentals and maintenance costs for renting third party Internet Servers which are substantial amount of costs to users.

In view of this, the inventor conducted researches and developed a security system implemented with a smart communication device. With the smart communication device, users are allowed to transmit text messages, pictures and films without complicated installing procedures and additional Internet Servers previously required for data transmission.

SUMMARY OF THE INVENTION

The objective of the invention is to provide a security system implemented with a communication device such that a user is informed of the status occurred in a remote monitoring location by transmitting a text messages or dialing out a video call via general messaging services with a communication device.

In order to achieve the above objective, the present invention comprises a remote communication device, a local communication device, a main controller and a or more than a main sensor. The remote communication device and local communication device are connected via communication connection. Each main sensor detects status of a monitoring location. When each main sensor is triggered, each main sensor sends an output signal to the main controller. The main controller collects and processes each output signal, and transmits the processed output signals to the local communication device. The local communication device transforms received output signals into a text warning message. The text warning message transmits to remote communication device via Short Message Service.

Compare to prior art, the advantages provided by the present invention are, a user controls each switch device installed in a monitoring location by sending text messages with a remote communication device send with the communication connection between the remote communication device and the local communication device. In addition, the local communication device returns a text message via Short Message Service (SMS), returns pictures via Multimedia Message Service (MMS), or returns real-time recording films via dialing out a video phone call to report the status of monitoring location. Thus, user is allowed to remotely monitor the status occurred in the monitoring location with various methods and precisely and immediately acts on any accident happened in the monitoring location

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to preferred embodiments, being not used to limit its executing scope. Any equivalent variation and modification made according to appended claims is all covered by the claims claimed by the present invention.

Figure 1:
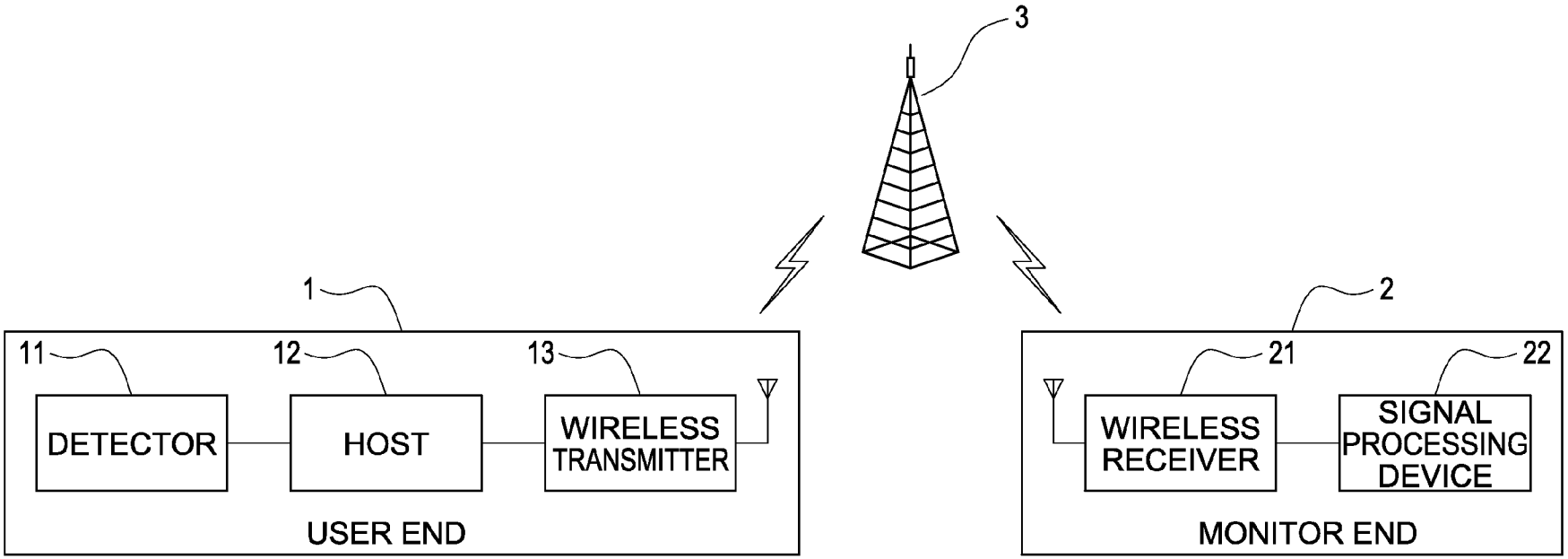
FIG.1 PRIOR ART
FIG. 1 is an architecture diagram of a prior art wireless security system.
Figure 2:
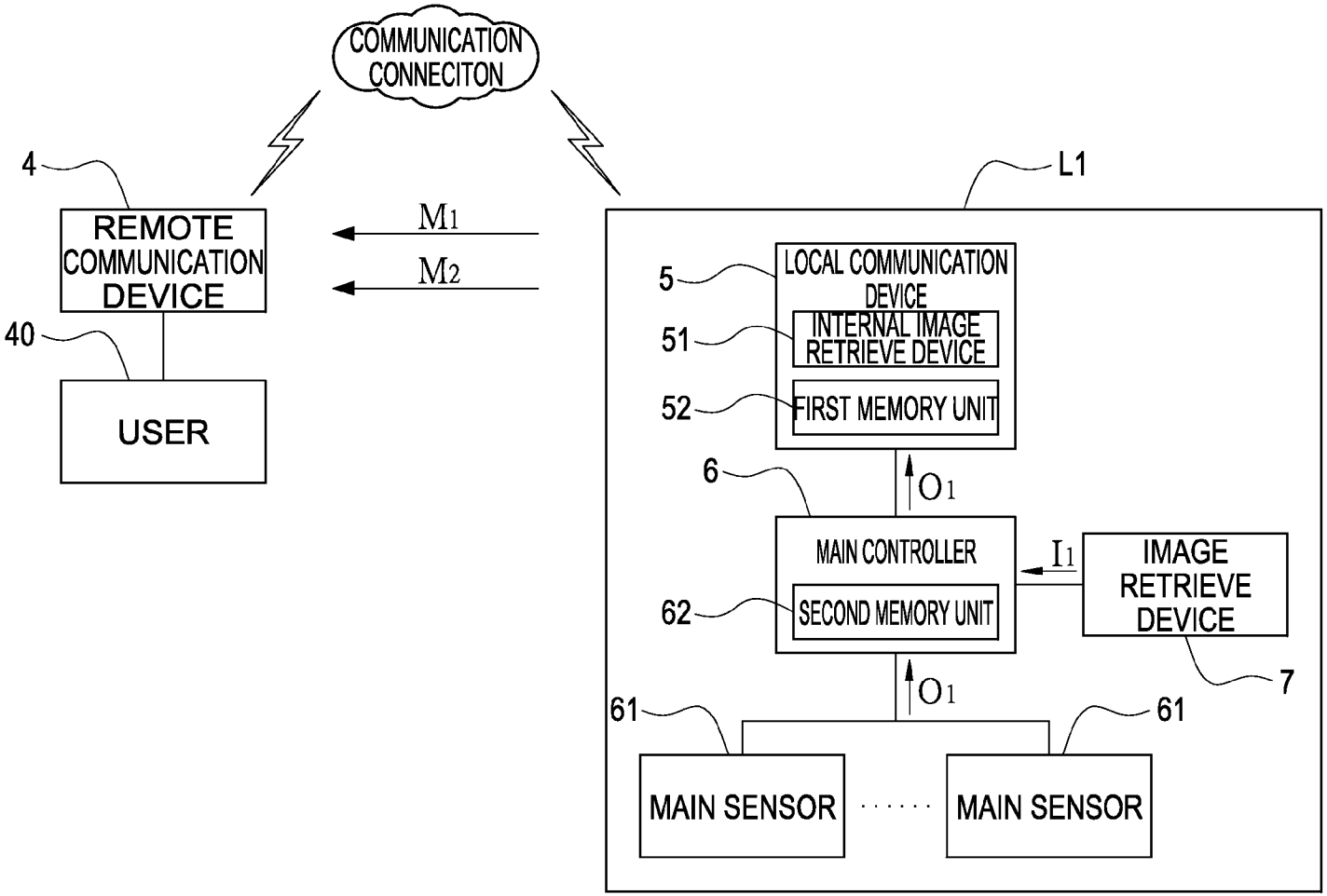
FIG. 2 is a system architecture diagram of a preferred embodiment according to the present invention.

FIG. 2 is a system architecture diagram of a preferred embodiment according to the present invention. The security system of the present invention has a remote communication device 4, a local communication device 5, a main controller 6 and one or more than one main sensor 61. The user 40 carries the remote communication device 4. The local communication device 5, the main controller 6 and each main sensor 61 are installed in a monitoring location L1. The monitoring location L1 is a residence, a company, a manufacturing factory, or a car. The remote communication device 4 and the local communication device 5 which is a mobile phone are connected to each other via a communication connection. Thus, the user 40 is allowed to remotely monitor the status of the monitoring location L1 via the remote communication device 4.

The local communication device 5 is connected to the main controller 6 via a Universal Serial Bus (USB) interface or a Bluetooth interface. The main controller 6 is electrically coupled to each main sensor 61 via a General Purpose I/O (GPIO) interface, but is not limited thereto. Each main sensor 61 can be for example a magnetism reed sensor, a smoke sensor, a temperature sensor, a carbon monoxide concentration sensor and a carbon dioxide concentration sensor used for detecting if a fire accident occurs, but is not limited thereto. Each main sensor 61 is used for detecting the status of the monitoring location L1. When each main sensor 61 is triggered, each main sensor 61 respectively sends a output signal O1 to the main controller 6. The main controller 6 collects and processes the output signals O1 via an internal Central Processing Unit (not shown in the diagram), and transmits the processed output signals O1 to the local communication device 5. Thus, the local communication device 5 transforms the output signals O1 into a text warning message M1, and transmits the text warning message M1 to the remote communication device 4 via Short Message Service (SMS). Accordingly, the user 40 uses the remote communication device 4 for displaying the text warning message M1, and is informed of the status of the monitoring location L1 via the text description of the text warning message M1.

The monitoring location L1 further comprises a image retrieve device 7, which is a digital camera or a Complementary Metal-Oxide-Semiconductor (CMOS). The image retrieve device 7 is electrically coupled to the main controller 6. If the image retrieve device 7 is a digital camera, the image retrieve device 7 outputs signals of National Television System Committee (NTSC) format or Phase Alternating Line (PAL) format to the main controller 6. If the image retrieve device 7 is a CMOS image sensing component, the image retrieve device 7 retrieves films of the monitoring location and directly outputting to the main controller 6. Further, in addition to the above mentioned image retrieve device 7, the local communication device 5 can also comprises an internal image retrieve device 51, which is a digital camera installed in the local communication device 5. The above embodiments are preferred embodiments according to the present invention and the embodiments of the present invention are not limited thereto.

When each main sensor 61 is triggered, the main controller 6 controls the starting of the image retrieve device 7, or the local communication device 5 controls the starting the internal image retrieve device 51 to retrieve films of the monitoring location L1 in order to generate a retrieved picture I1. Lastly, the local communication device 5 receives and transforms the retrieved picture I1 and the output signals O1 into a picture warning message M2. The picture warning message M2 is transmitted to the remote communication device 4 via Multimedia Messaging Service (MMS). Accordingly, the user 40 displays the picture warning message M2 with the remote communication device 4. Thus the status of the monitoring location L1 is shown clearly by the picture displayed.

It should be noted that the local communication device 5 and the main controller 6 respectively has a first memory unit 52 and a second memory unit 62, preferably a memory or a memory card. When the retrieved picture I1 is generated by the image retrieve device 7 or the internal image retrieve device 51, the local communication device 5 and/or the main controller 6 saves the retrieved picture I1 in the first memory unit 52 and the second memory unit 62 for future reference when required.

Figure 3:
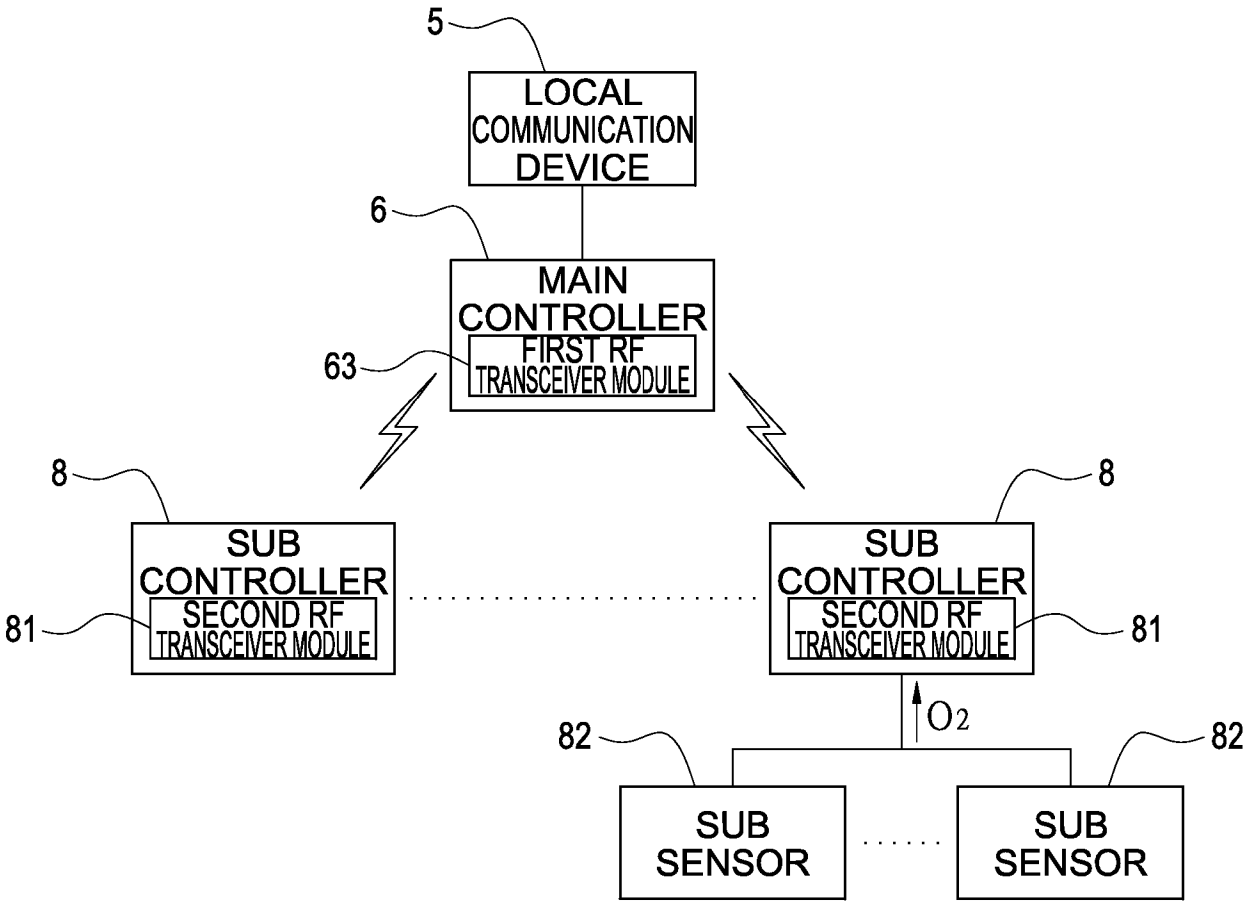
FIG. 3 is another system architecture diagram of a preferred embodiment according to the present invention.

FIG. 3 is another system architecture diagram of a preferred embodiment according to the present invention. As shown in the diagram, the main controller 6 can further connects to a or more than a sub controller 8. Each sub controller 8 are installed in the monitoring location L1 away from the main controller 6. The main controller 6 has a first RF transceiver module 63. Each sub controller 8 respectively has a second RF transceiver module 81. The main controller 6 and each sub controller 8 are connected via RF transmission. Each sub controller 8 respectively connects to one or more than one sub sensor 82, wherein each sub controller 8 connects to each sub sensor 82 via a GPIO interface but is not limited thereto. Each sub sensor 82 detects the status of the monitoring location L1. When each sub sensor 82 is triggered, each sub sensor 82 respectively sends a sub output signal O2 to each sub controller 8. Each sub controller 8 collects and processes the sub output signals O2 via an internal Central Processing Unit (shown in the diagram). The processed sub output signals O2 are transmitted to the main controller 6. Thus the main controller 6 collects and processes the output signals O1. The sub output signals O2 and the retrieved picture I1 are transmitted to the local communication device 5. The local communication device 5 transforms the sub output signals O2 and the retrieved picture I1 into the text warning message M1 and/or the picture warning message M2. The text warning message M1 and/or the picture warning message M2 are transmitted to the remote communication device 4 via SMS and/or MMS.

Figure 4:
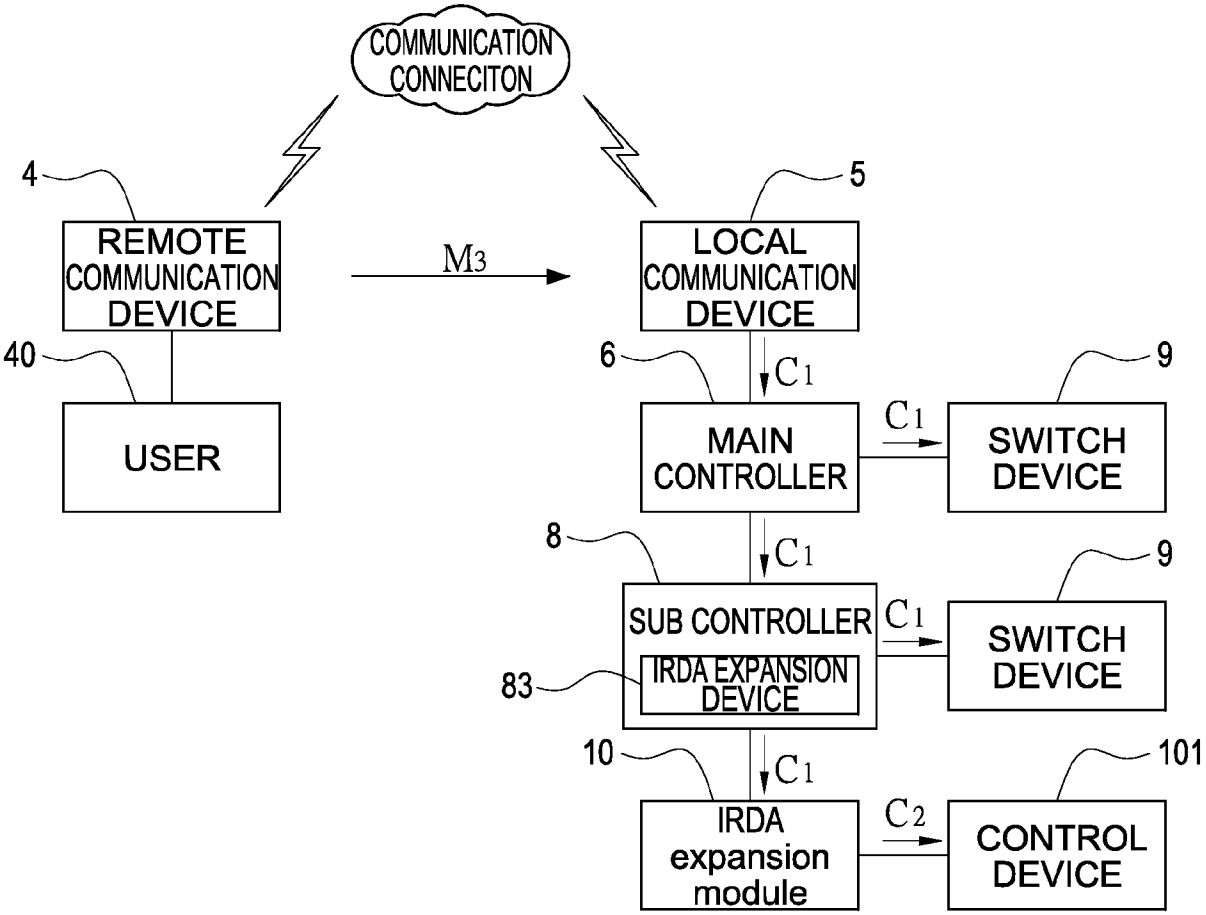
FIG. 4 is still another system architecture diagram of a preferred embodiment according to the present invention.

FIG. 4 is still another system architecture diagram of a preferred embodiment according to the present invention. As shown in the diagram, the monitoring location L1 further comprises one or more than one switch device 9. Each switch device 9 connects to the main controller 6 and/or each sub controller 8 via a GPIO interface. Each switch device 9 can be a switch of an electronic device such as a lighting device or a relay, and operates to turn ON, OFF and multi-mode switching but is not limited thereto. Each sub controller 8 further has a IrDA expansion device 83 to connects to an external IrDA expansion module 10. Thus, a control device 101 installed in the monitoring location L1 is remotely controlled via Infrared. The control device 101 can be an electronic appliance controlled by such Infrared as an air conditioner or a television but is not limited thereto.

The user 40 edits an instruction message M3 via the remote communication device 4 and transmits via SMS to the local communication device 5. The local communication device 5 determines whether the phone number of the remote communication device 4 is an authorized phone number. If yes, the local communication device 5 receives and analyzes the content of the instruction message M3 to extract a control instruction C1. Thus, the control instruction C1 is transmitted to the main controller 6 and/or each sub controller 8 to control each switch device 9 connected to the main controller 6 and/or each sub controller 8 by performing corresponding operations, for example, exerting control to turn on the switch of a relay, control the current and switching status of a lighting device, or retrieving status of each switch device 9. Further, each sub controller 8 transmits the control instruction C1 to the IrDA expansion module 10 via the IrDA expansion device 83. Thus the IrDA expansion module 10 transforms the control instruction C1 into an Infrared control signals C2. The Infrared control signals C2 is transmitted to the control device 101 to control operations of the control device 101.

When each switch device 9 is controlled to switch the status, each switch device 9 automatically returns the current status of the switch device to the main controller 6 and/or each sub controller 8. The current status of the switch device is returned to the remote communication device 4 via the local communication device 5. However, the user 40 may configure to not to return the current status of the switch device and request each switch device 9 to current switch status by sending the instruction message M3 via the remote communication device 4 or the local communication device 5, but is not limited thereto.

If the remote communication device 4 and the local communication device 5 both have video phone dialing out function, the user 40 can be informed of the status of the monitoring location L1 by receiving real-time films further by dialing out a video phone call. The user 40 edits the instruction message M3 via the remote communication device 4 and the instruction message M3 is transmitted to the local communication device 5. The local communication device 5 first determines if the phone number of the remote communication device 4 is an authorized phone number. If yes, the local communication device 5 receives and analyzes the content of the instruction message M3 to extract the control instruction C1. The main controller 6 starts the image retrieve device 7 according to the control instruction C1, or, the local communication device 5 starts the internal image retrieve device 51 according to the control instruction C1 to record films of the monitoring location L1. In addition, the local communication device 5 receives the films recorded by the image retrieve device 7 or the internal image retrieve device 51 and dials out a video phone call to the remote communication device 4. When the video phone call is connected, the user 40 is allowed to watch the films recorded by the monitoring location L1 by the image retrieve device 7 or the internal image retrieve device 51 via the remote communication device 4. Thus, the user 40 can precisely proceed to appropriate operations according to the real-time films displayed.

It should be noted that if the user 40 is located in the monitoring location L1, the user 40 can directly control the local communication device 5 to monitor the status. For example, the user 40 directly sends the control instruction C1 to each switch device 9 via the local communication device 5 to control operations of each switch device 9, or retrieving the current switch status. Or, the user 40 sends the control instruction C1 to each main sensor 61 and/or each sub sensor 82 to request each main sensor 61 and/or each sub sensor 82 to return current detect results.

As the skilled person will appreciate, various changes and modifications can be made to the described embodiments. It is intended to include all such variations, modifications and equivalents which fall within the scope of the invention, as defined in the accompanying claims.

What is claimed is:

1. A security system implemented with a communication device used for remote monitoring the status of a monitoring location, the security system comprising:

a remote communication device, which is a mobile phone;

a local communication device, which is a mobile phone installed in the monitoring location, and connected with the remote communication device via a communication connection;

an internal image retrieve device installed in the local communication device;

a main controller installed in the monitoring location, and connected with the local communication device; and at least one main sensor installed in the monitoring location, and electrically coupled to the main controller;

wherein, when each main sensor is triggered, each main sensor respectively sends an output signal to the main controller, the main controller collects and processes the output signals and transmits the processed output signals to the local communication device, whereby the local communication device transforms the output signals into a text warning message and transmits the text warning message to the remote communication device via short messaging service (SMS);

wherein, when one of each main sensor is triggered the internal image retrieve device is started to retrieve films of the monitoring location to generate a retrieved picture, the local communication device transforms the retrieved picture and the output signals into a picture warning message and transmits the picture warning message to the remote communication device via multimedia messaging service (MMS), and wherein the remote communication device and the local communication device has video phone call dialing out function, the remote communication device edits an instruction message and transmits the instruction message to the local communication device via SMS, the local communication device analyzes the instruction message to extract a control instruction, starts the internal image retrieve device according to the control instruction, and dials out a video phone call to the remote communication device, whereby films of the monitoring location recorded by the internal image retrieve device are transmitted to the remote communication device following the video phone call is connected.

2. The security system implemented with a communication device of claim 1, wherein the local communication device is connected to the main controller via a universal serial bus (USB) interface or a bluetooth interface, the main controller is electrically coupled to each main sensor via a general purpose I/O (GPIO) interface.

3. The security system implemented with a communication device of claim 1, wherein the internal image retrieve device is a digital camera, and the local communication device further has a first memory unit for saving the retrieved picture, wherein the first memory unit is a memory or a memory card.

4. The security system implemented with a communication device of claim 3, further comprising an image retrieve device installed in the monitoring location, electrically coupled to the main controller, started to retrieve films of the monitoring location to generate a retrieved picture and transmitting the retrieved picture to the main controller when one of each main sensor is triggered, whereby the main controller transmits the retrieved picture and the output signals to the local communication device, the local communication device transforms the retrieved picture and the output signals into a picture warning message, and transmits the picture warning message to the remote communication device via MMS.

5. The security system implemented with a communication device of claim 4, wherein the image retrieve device is a digital camera and outputs signals of national television system committee (NTSC) format or phase alternating line (PAL) format to the main controller, and the main controller further has a second memory unit for saving the retrieved picture, wherein the second memory unit is a memory or a memory card.

6. The security system implemented with a communication device of claim 4, wherein the image retrieve device is a complementary metal-oxide-semiconductor (CMOS) image sensing component and retrieves films of the monitoring location and directly outputting to the main controller, and the main controller further has a second memory unit for saving the retrieved picture, wherein the second memory unit is a memory or a memory card.

7. The security system implemented with a communication device of claim 1, further comprising:

at least one sub controller installed in the monitoring location and connected to the main controller; and at least one sub sensor installed in the monitoring location and electrically coupled to each sub controller;

wherein, when each sub sensor is triggered, each sub sensor respectively sends a sub output signal to each sub controller, each sub controller collects and processes the sub output signals, and transmits the processed output signals to the main controller.

8. The security system implemented with a communication device of claim 7, further comprising at least one switch device, electrically coupled to the main controller or each sub controller, and the remote communication device edits an instruction message and transmits to the local communication device via SMS, the local communication device analyzes the instruction message to extract a control instruction, and control operations of each switch device connected to the main controller or each sub controller according to the control instruction.

9. The security system implemented with a communication device of claim 8, wherein the control instruction comprises controlling current switch status of each switch device ON, OFF, multi-mode switching and retrieving the switch device.

10. The security system implemented with a communication device of claim 8, wherein each switch device is electrically coupled to the main controller or each sub controller via GPIO interface, and each sub controller is electrically coupled to the each sub sensor via GPIO interface.

11. The security system implemented with a communication device of claim 8, wherein each sub controller further comprises an IrDA expansion device to connect to external IrDA expansion module, the remote communication device edits an instruction message and transmits the instruction message to the local communication device via SMS, the local communication device analyzes the instruction message to extract a control instruction and transmits the control instruction to each sub controller via the main controller, each sub controller transmits the control instruction to the IrDA expansion module, whereby an Infrared control signal is generated according to the control instruction, the remote control is installed a control device in the monitoring location.

12. The security system implemented with a communication device of claim 11, wherein the control device is an air conditioner or a television.

13. The security system implemented with a communication device of claim 8, wherein the main controller further comprises a first RF transceiver module, each sub controller further comprises a second RF transceiver module, and the main controller and each sub controller are connected via RF transmission.

14. A security system implemented with a communication device used for remote monitoring the status of a monitoring location, the security system comprising:

a remote communication device, which is a mobile phone;

a local communication device, which is a mobile phone installed in the monitoring location, and connected with the remote communication device via a communication connection;

a main controller installed in the monitoring location, and connected with the local communication device;

at least one sub controller installed in the monitoring location and connected to the main controller;

at least one main sensor installed in the monitoring location, and electrically coupled to the main controller;

at least one sub sensor installed in the monitoring location and electrically coupled to each sub controller; and at least one switch device, electrically coupled to the main controller or each sub controller, wherein the remote communication device edits an instruction message and transmits to the local communication device via short messaging service (SMS), and the local communication device analyzes the instruction message to extract a control instruction and control operations of each switch device connected to the main controller or each sub controller according to the control instruction, wherein, when each sub sensor is triggered, each sub sensor respectively sends a sub output signal to each sub controller, each sub controller collects and processes the sub output signals, and transmits the processed output signals to the main controller, wherein, when each main sensor is triggered, each main sensor respectively sends an output signal to the main controller, the main controller collects and processes the output signals and transmits the processed output signals to the local communication device, whereby the local communication device transforms the output signals into a text warning message and transmits the text warning message to the remote communication device via SMS.

15. The security system implemented with a communication device of claim 14, wherein the control instruction comprises controlling current switch status of each switch device ON, OFF, multi-mode switching and retrieving the switch device.

16. The security system implemented with a communication device of claim 14, wherein each switch device is electrically coupled to the main controller or each sub controller via GPIO interface, and each sub controller is electrically coupled to the each sub sensor via GPIO interface.

17. The security system implemented with a communication device of claim 14, wherein each sub controller further comprises an IrDA expansion device to connect to external IrDA expansion module, the remote communication device edits an instruction message and transmits the instruction message to the local communication device via SMS, the local communication device analyzes the instruction message to extract a control instruction and transmits the control instruction to each sub controller via the main controller, each sub controller transmits the control instruction to the IrDA expansion module, whereby an Infrared control signal is generated according to the control instruction, the remote control is installed a control device in the monitoring location.

18. The security system implemented with a communication device of claim 17, wherein the control device is an air conditioner or a television.

19. The security system implemented with a communication device of claim 14, wherein the main controller further comprises a first RF transceiver module, each sub controller further comprises a second RF transceiver module, and the main controller and each sub controller are connected via RF transmission.

* * * * *